US007165556B2

(12) United States Patent
Gilbert et al.

(10) Patent No.: US 7,165,556 B2
(45) Date of Patent: Jan. 23, 2007

(54) COMPOSITE HANDLE FOR GROOMING IMPLEMENTS

(75) Inventors: Kathryn Gilbert, Lincolnshire, IL (US); Neil Davis, New York, NY (US)

(73) Assignee: Paris Presents, Inc., Gurnee, IL (US)

( * ) Notice: Subject to any disclaimer, the term of this patent is extended or adjusted under 35 U.S.C. 154(b) by 0 days.

(21) Appl. No.: 10/293,121

(22) Filed: Nov. 13, 2002

(65) Prior Publication Data

US 2003/0111089 A1 Jun. 19, 2003

Related U.S. Application Data

(60) Provisional application No. 60/341,890, filed on Dec. 18, 2001.

(51) Int. Cl.
*A45D 24/00* (2006.01)
*A45D 29/18* (2006.01)

(52) U.S. Cl. ..... 132/150; 132/76.4

(58) Field of Classification Search ..... 132/76.4, 132/75.6, 73.5, 150, 148, 309, 74.6, 308, 132/316; 16/436, 431, DIG. 12, DIG. 19; 15/143.1

See application file for complete search history.

(56) References Cited

U.S. PATENT DOCUMENTS

| | | | | |
|---|---|---|---|---|
| 3,916,918 | A * | 11/1975 | Spinks | 132/219 |
| 4,721,021 | A * | 1/1988 | Kusznir | 81/22 |
| 4,739,536 | A * | 4/1988 | Bandera et al. | 16/430 |
| 5,465,740 | A * | 11/1995 | Kim | 132/73.6 |
| 5,479,951 | A * | 1/1996 | Denebeim | 132/265 |
| 5,546,658 | A * | 8/1996 | MacLeod et al. | 30/28 |
| 5,934,295 | A * | 8/1999 | Gekhter et al. | 132/309 |
| 6,234,798 | B1 * | 5/2001 | Beals et al. | 433/216 |
| 6,662,406 | B1 * | 12/2003 | Shonfeld et al. | 16/431 |

FOREIGN PATENT DOCUMENTS

GB 2299750 A * 10/1996

* cited by examiner

*Primary Examiner*—John J. Wilson
*Assistant Examiner*—Robyn Doan
(74) *Attorney, Agent, or Firm*—Gerald K. White

(57) ABSTRACT

A composite handle for grooming implements provides improved control during use. Such handle has a rigid and a flexible portion that facilitates use of the implement, especially when a user has a weak or impaired grip.

18 Claims, 1 Drawing Sheet

COMPOSITE HANDLE FOR GROOMING IMPLEMENTS

This patent application claims priority under 35 U.S.C. 119(e) from provisional application Ser. No. 60/341,890, filed Dec. 18, 2001, which is incorporated herein by reference in its entirety.

The present invention is directed to a composite handle suitable for grooming implements used in cosmetic and beauty processes. Examples of such implements include nail files, nail clippers, combs, brushes, mirrors, etc. Such handle facilitates and improves gripping and control of the implement during use.

BACKGROUND OF THE INVENTION

In the past, grooming implements for performing, assisting, and/or viewing cosmetic and beauty processes, such as manicures, pedicures, brushing, combing, styling, clipping, cutting, applying cosmetics, etc., have been provided with and without handles. The same situation pertains to related grooming implements, such as mirrors. Handles function to enhance or facilitate gripping by the user and thus offer the ability for the user to improve control of cosmetic and beauty processes. Typically, such handles have a smooth, flat plastic surface and are rigid when gripped by a user. Such handles may contain a slot to receive and secure an end portion of a grooming implement. Such implement end portion may be inserted into the opening and then affixed, thereby connecting the implement end to the handle. An adhesive affords a convenient means of affixing the respective parts.

The present invention offers an improvement to the above-mentioned grooming implements through use of a handle, which provides improved gripping ability, and hence, control, by the user. The improved gripping ability of the handle can be important if the user suffers from hand weakness or impairment, which would reduce, or even impede, the ability to efficiently use the implement. As can be appreciated, overall ease of use is enhanced by the invention.

SUMMARY OF THE INVENTION

The present invention generally comprises a composite handle for grooming implements. The composite handle is connected to an end of a functional portion of the implement. Such implements may be a nail file, a brush, a comb, a nail clipper, a mirror, or the like. The composite handle has at least two portions—a rigid portion and a flexible portion. Such composite handle functions to facilitate gripping and control by the user.

More specifically, the composite handle contains a rigid portion and a flexible portion, with the flexible portion located at a central area of the rigid portion. Such combination and location facilitates gripping and control when used. The flexible portion may comprise a plug, which may be inserted into the rigid portion of the handle. Desirably, the plug may extend completely through the rigid portion and thus forming flexible surfaces on opposite sides of the rigid portion thereby permitting a user to grip said handle at its flexible portion with at least one finger and a thumb. The plug may contain a slot, which is adapted to receive and become affixed, and thereby connected to, an end portion of a grooming implement.

DETAILED DESCRIPTION OF THE INVENTION

The grooming implement of the present invention contains a handle that provides improved gripping and hence control of the implement by the user. Such ability to control the movement of the implement is a beneficial attribute of the invention. This benefit is illustrated by considering a nail file. Improved control of nail filing processes result in the achievement of desired nail shape and smoothness of fingernails and/or toenails. Also, potentially harmful contact with skin adjacent to the nail is thereby minimized. Obviously, improved control of a nail clipper would also achieve the above benefits. Improved gripping may become important should a user have weakened or impaired hands and thus would otherwise have difficulty in exercising the necessary control of the implement.

Figure 1:
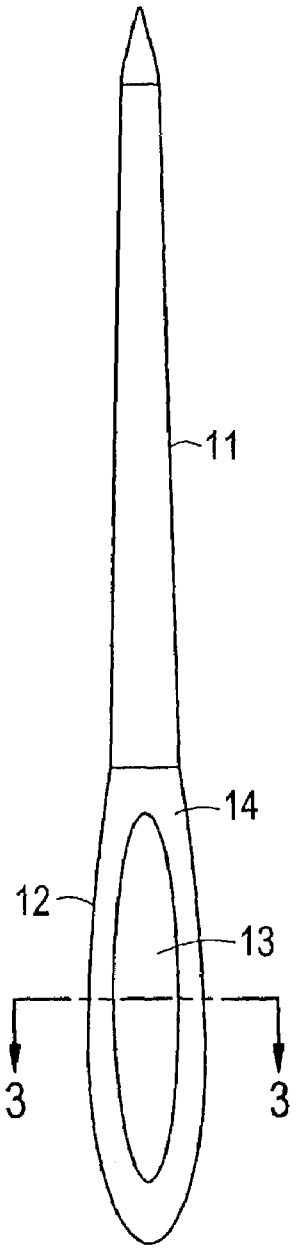
FIG. 1 is a top view of a nail file.

FIG. 1 is a top view of a nail file, which was chosen to illustrate one of the grooming implements of the invention. The nail file comprises file member 11 which has an end inserted into and connected to or affixed to handle 12. Rigid portion 14 of handle 12 may desirably be bulbous in shape to further facilitate gripping by the user. Oval shaped area 13 in handle 12 is comprised of a flexible material thereby creating a flexible surface portion. Such flexible surface portion may be contoured to be compatible with the surface contour of rigid portion 14. Typical flexible materials include but are not limited to rubber, foams, and spongy material, etc. Typical rigid materials include but are not limited to plastic, metal, glass, wood, ceramic, etc. Such materials may be coated if desired. The combination of rigidity and flexibility serves to create a handle having sufficient overall rigidity to control the filing or other desired process but yet having flexibility to obtain improved gripping. Such flexible portion is desirably located at a central area on opposing surfaces of the handle whereby contact at the flexible portion by at least one finger and the thumb of a user is facilitated. As may be seen, the composite handle of the invention possesses a highly desirable combination of rigidity and gripping ability, as contrasted to a handle comprised solely of a rigid or flexible material.

Figure 2:
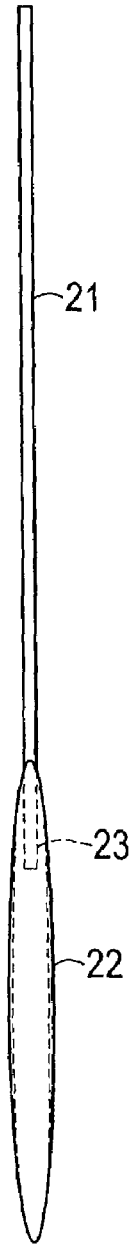
FIG. 2 is a side view of a nail file.

FIG. 2 is a side view of a nail file illustrating one technique for connecting the file end member to the handle. As may be seen, file member 21 is inserted into slot 23 of handle 22. Connection then may be conveniently accomplished with use of an adhesive, bonding, pressure fitting, or any other means. File member 21 may be comprised of metal, emery board, or any other type of desired abrasive material. File member 21 may be inserted into a slot of a plug (not shown in this Figure) to enable file member 21 to be received and then adhered to become connected in said slot.

Figure 3:
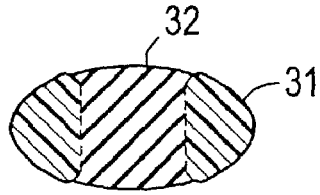
FIG. 3 is a cross-sectional view of a nail file taken along line a—a of FIG. 1.

FIG. 3 is a cross-sectional view of a nail file as viewed along line 3—3 of FIG. 1. Portion 31 is the rigid portion of the handle, and flexible portion 32 is the flexible portion. Flexible portion 32 comprises a plug inserted into such rigid portion of the handle.

Figure 4:
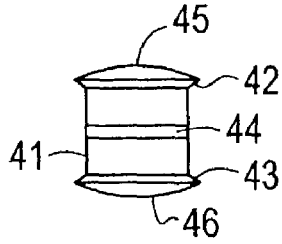
FIG. 4 is a side view of a plug adapted to be inserted and snapped into the handle of a grooming implement.

FIG. 4 depicts a side view of a snap-in plug that is adapted to be inserted and snap fitted into an opening of the handle. Plug 41 may be comprised of a flexible material such as rubber, and contains flexible lips 42 and 43 and insert opening 44. Such opening is adapted to receive and retain the file member. Once snapped into place, the plug is retained in the handle by lips 42 and 43. Top 45 and bottom 46 of plug 41 are rounded, and thus may be adapted to conform to a bulbous rigid surface portion of the handle. Such rounded surface further enhances gripping by the user. It is also possible to improve gripping by providing indentations or suitably roughening the surfaces 45 and 46 of plug 41.

The composite handle of the invention comprises providing a rigid handle with an opening and then placing and affixing a plug made from a flexible material such as rubber or the like in such opening to create the desired composite handle. The plug may extend completely through the rigid handle or only through a portion thereof. It is preferred to extend the opening through the handle to result in flexible material on opposing sides of the handle. The plug may be affixed by an adhesive or the like. However, it is preferred to utilize a snap-in plug, such as illustrated in FIG. 4.

While it is shown in FIG. 3 that the surfaces of the rigid members and the plug are essentially flush and smooth, it is contemplated that the plug could be recessed in the handle opening or extend above the rigid material. The latter structure would further enhance gripping by the user by assisting in the formation of a bulbous-shaped handle.

It is claimed:

1. A grooming implement selected from the group consisting of a nail file, a brush, a comb, a nail clipper, and a mirror having a composite handle comprising a bulbous rigid surface portion and a rounded flexible surface portion contained within an essentially flush with said rigid surface portion at opposite top and bottom surfaces of said handle and located at a central area of such rigid portion, said flexible surface portion of said handle comprising a plug inserted into and extending completely through said rigid portion thus forming flexible surface portions on opposite sides of said rigid portion thereby permitting a user to grip said handle at said flexible surface portions at opposite sides of said handle with at least one finger and a thumb during use of said grooming implement, said flexible surface portions and said rigid portion forming an essentially smooth surface on said handle, said handle being connected to an end portion of a functional member of said grooming implement.

2. The grooming implement of claim 1, wherein said implement comprises a nail file.

3. The grooming implement of claim 1, wherein said implement comprises a brush.

4. The grooming implement of claim 1, wherein said implement comprises a comb.

5. The grooming implement of claim 1, wherein said implement comprises a nail clipper.

6. The grooming implement of claim 1, wherein said implement comprises a mirror.

7. A grooming implement selected from the group consisting of a nail file, a brush, a comb, a nail clipper, and a mirror having a composite handle comprising rigid and rounded flexible surface portions, said flexible portions essentially flush with said rigid portions and contained with said rigid portion and located at a central area of said rigid portion, at opposite top and bottom surfaces of said handle, said flexible surface portions located at opposite top and bottom surfaces of said rigid portion of said handle, thereby forming flexible griping surfaces, said flexible portions of said handle adapted to be contacted by a hand of a user thereby permitting said user to grip said handle at said flexible surface portions with at least one finger and a thumb during use of said grooming implement, thereby facilitating gripping and control by said user, said handle being connected to an end portion of said grooming implement.

8. The grooming implement of claim 7, wherein said flexible portion comprises a plug which is inserted into said central area of said rigid portion.

9. The grooming implement of claim 8, wherein said implement comprises a nail file.

10. The grooming implement of claim 8, wherein said implement comprises a brush.

11. The grooming implement of claim 8, wherein said implement comprises a comb.

12. The grooming implement of claim 8, wherein said implement comprises a nail clipper.

13. The grooming implement of claim 8, wherein said implement comprises a mirror.

14. The grooming implement of claim 7, wherein said implement comprises a nail file.

15. The grooming implement of claim 7, wherein said implement comprises a brush.

16. The grooming implement of claim 7, wherein said implement comprises a comb.

17. The grooming implement of claim 7, wherein said implement comprises a nail clipper.

18. The grooming implement of claim 7, wherein said implement comprises a mirror.

* * * * *